US008011705B1

(12) United States Patent
Holbrook

(10) Patent No.: US 8,011,705 B1
(45) Date of Patent: Sep. 6, 2011

(54) WASTE RETRIEVAL DEVICE WITH INTEGRAL STORAGE STAND

(76) Inventor: Paul Robert Holbrook, Buffalo Grove, IL (US)

( * ) Notice: Subject to any disclaimer, the term of this patent is extended or adjusted under 35 U.S.C. 154(b) by 306 days.

(21) Appl. No.: 12/386,013

(22) Filed: Apr. 13, 2009

Related U.S. Application Data

(63) Continuation-in-part of application No. 11/973,794, filed on Oct. 11, 2007, now abandoned.

(51) Int. Cl.
*A01K 29/00* (2006.01)
*E01H 1/12* (2006.01)

(52) U.S. Cl. ..... 294/1.4

(58) Field of Classification Search ..... 294/1.3, 294/1.4, 1.5, 55; 15/104.8, 257.1, 257.4; 119/161
See application file for complete search history.

(56) References Cited

U.S. PATENT DOCUMENTS

| | | | | | |
|---|---|---|---|---|---|
| 3,827,098 | A | * | 8/1974 | Sanderson | 294/1.4 |
| 4,119,337 | A | * | 10/1978 | Sherhandt | 294/1.4 |
| 4,225,174 | A | * | 9/1980 | Hennessy et al. | 294/1.4 |
| 4,248,468 | A | * | 2/1981 | Hastings | 294/1.4 |
| 4,368,907 | A | * | 1/1983 | Ross | 294/1.4 |
| 4,741,566 | A | * | 5/1988 | Byung-Do et al. | 294/1.4 |
| 5,056,842 | A | * | 10/1991 | Lindenberg et al. | 294/1.4 |
| 5,601,321 | A | * | 2/1997 | Simon | 294/1.4 |
| 5,702,138 | A | * | 12/1997 | Elkind | 294/1.4 |
| 6,135,520 | A | * | 10/2000 | Miller et al. | 294/1.4 |

* cited by examiner

*Primary Examiner* — Dean J Kramer

(57) ABSTRACT

A waste retrieval device with integral storage stand. The integral storage stand provides for vertical storage of the waste retrieval portion and prevents any waste which may be adhering to the scoop jaws from contacting other surfaces.

10 Claims, 4 Drawing Sheets

WASTE RETRIEVAL DEVICE WITH INTEGRAL STORAGE STAND

RELATED APPLICATIONS

This is a continuation in part of application Ser. No. 11/973,794, filed Oct. 11, 2007 now abandoned.

FEDERALLY SPONSORED RESEARCH/DEVELOPMENT

None

MICROFICHE APPENDIX

None

BACKGROUND OF THE INVENTION

1. Field of the Invention

The present invention relates to a waste retrieval device with an integral storage stand. In particular, the present invention relates to a hand activated spring biased waste retriever with integral storage stand.

2. Prior Art

Several devices exist for the retrieval of pet waste. U.S. Pat. No. 4,248,468 to Hastings discloses one such device. The Hastings patent discloses a litter retrieval device formed of an elongated unitary plastic frame having a handle section at one end, scoop-supporting arms at the other end, and an elongated central section having a passageway for receiving a control rod. The control rod extends through the passageway from the handle to the scoops. Linkages connect the lower end of the control rod to the scoops and spring biasing means are provided for biasing the scoops in a closed position.

Another such device is U.S. Pat. No. 5,601,321 to Simon. This device has a similar design to the '468 patent, however the improvements appear to be the requirements for two pairs of linkage arms connecting the inner frame member to the scoop means, and the integration of the linkage arms with the inner frame member.

One disadvantage of such devices is that upon conclusion of the waste pickup, it is not uncommon to have waste adhere to the exterior of the scoop jaws, creating an unsightly and unsanitary condition. In this instance, upon conclusion of the waste pickup, users may be reluctant to transport the device within the "clean" areas of a house, deck or patio for fear of waste dropping off or contacting clean surfaces. Users must also find a means to store the soiled device since as there is no built-in storage means.

In view of the aforementioned disadvantage inherent in the known types of waste retrieval devices present in the prior art, my invention has 2 distinct advantages and improvements:

1. Vertical storage of the waste retrieval device, thus saving floor space.
2. Prevention of any waste residue on the scoop jaws from contacting other surfaces.

While my prior application Ser. No. 11/973,794 contains an embodiment entailing the use of a vertical storage stand with a waste retrieval device, this application describes a vertical storage stand which can remain attached to the waste retrieval device during use.

BRIEF SUMMARY OF THE INVENTION

In view of the aforementioned disadvantage inherent in the known types of waste retrieval devices present in the prior art, this invention provides a waste retrieval device with integral storage stand. The integral storage stand provides a free standing and cosmetically pleasing design when stored with all external surfaces being clean and free from waste residue, and remains attached to the waste retrieval device during use.

The system is comprised of a plurality of component elements. In their broadest context, such component elements include a waste retrieval portion similar to that found in the prior art, with the addition of an integral storage stand. The waste retrieval portion is formed of an elongated outer frame having a handle section at one end, scoop-supporting section at the other end, and an elongated central section having a passageway for receiving a control frame. The control frame extends through the passageway from the handle to the scoops. Links connect the lower end of the control frame to the scoops and spring biasing means are provided for biasing the scoops in a closed position. The improvement over the prior art involves the addition of a storage stand. The storage stand is pivotally attached to the outer frame near the scoop-supporting section such that it may be temporarily pivoted out of the way when operating the scoops. Upon conclusion of the pickup, the storage stand may be rotated back into position beneath the scoops. Locking features are provided such that the storage stand may be locked in the bottom position for storage, or in either of 2 other positions (rotated 90 degrees in either direction from bottom position) when the waste retrieval device is being used.

In one embodiment, the storage stand may be removable from the waste retrieval portion to allow easier cleaning of the scoops or the storage stand.

BRIEF DESCRIPTION OF THE DRAWINGS

The foregoing aspects and other features of the present invention are explained in the following description, taken in combination with the accompanying drawings, wherein.

DETAILED DESCRIPTION OF THE INVENTION

Figure 1:
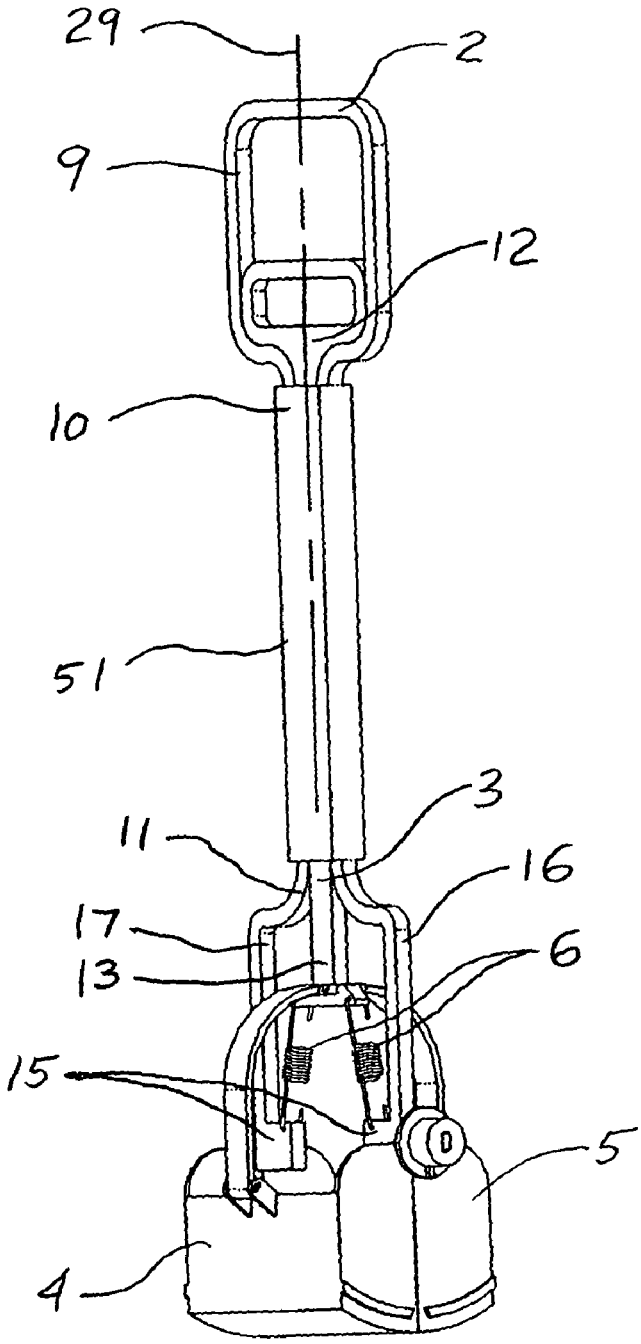
FIG. 1 is a perspective view of the waste retrieval device without the storage stand.

Referring to FIG. 1, waste retrieval portion 51 is comprised of outer frame 2, control frame 3, scoops 4 and 5 and biasing springs 6. Waste retrieval portion 51 has long axis 29.

Outer frame 2 has handle section 9, central section 10 and scoop supporting section 11. The outer frame 2 also includes braces 15 extending inward from vertical sides 16 and 17. Control frame 3 has handle end 12 and a scoop attachment end 13. Control frame 3 is captured within the outer frame 2 to provide for slidable motion of the control frame along the long axis 29 of the device.

Figure 2:
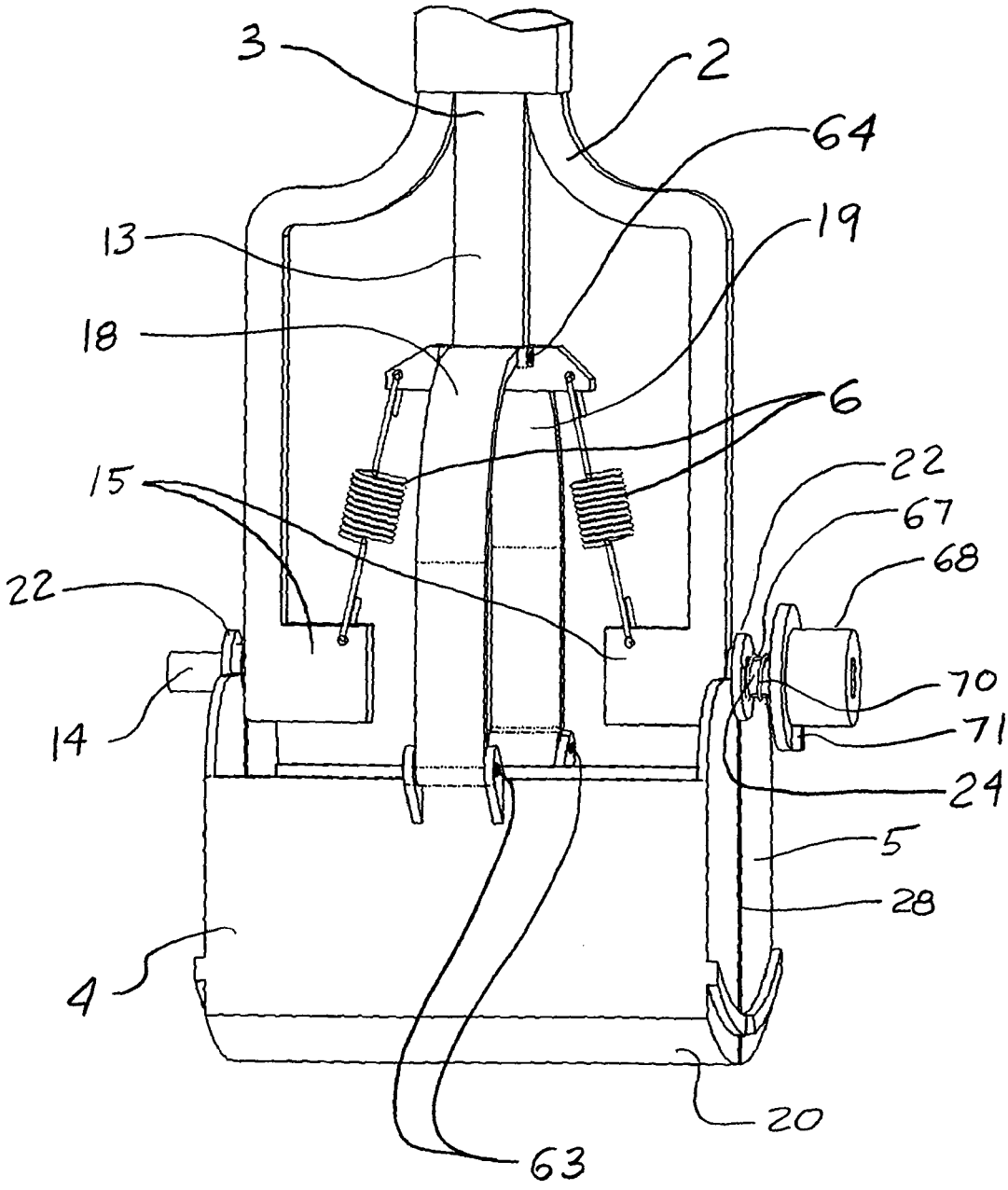
FIG. 2 is a close-up perspective view of the scoop end of the waste retrieval device without the storage stand.

Referring now to FIG. 2, scoops 4 and 5 are formed to mate with each other at edge 28. When the device has the scoops in the closed position as shown, the scoops mate so that they form a container having a closed bottom 20. Each scoop 4 and 5 has central pivot points 22 at each end where the scoops connect to the outer frame 2 and allow for rotation of the scoops about outer nipples 14 and 67 of outer frame 2. When a user pulls the handle end 12 of the control frame 3 upwardly toward the handle section 9 (see FIG. 1) of the outer frame 2 against the force of biasing springs 6, links 18 and 19 cause the scoops 4 and 5 to pivot in opposite directions, opening the bottom portion 20. The bottom of links 18 and 19 are pivotally mounted on the scoops at pivots 63, and the top of links 18 and 19 are pivotally mounted on scoop end 13 of control frame 3 at pivots 64. Biasing springs 6 are attached between control frame 3 and braces 15 of outer frame 2, providing the force to keep the scoops 4 and 5 in the closed position when handle section 12 (see FIG. 1) of control frame 3 is released. Biasing springs 6 are thus of the extension-spring type in the preferred embodiment.

In an alternate embodiment, only one scoop may rotate and the other scoop may be fixed.

Outer nipple 14 is cylindrical in shape, and outer nipple 67 is cylindrical with flats 24. Button 68 is slidably mounted on nipple 67 and flats 24 engage corresponding flats 69 (see FIG. 3) of button 68 to prevent relative rotation between the 2 parts. Compression spring 70 provides a force to push button 68 outboard. Tab 71 of button 68 engages holes 72 and 73 of storage stand 74 (see FIG. 3) and keeps storage stand fixed in a one of 3 given positions.

Figure 3:
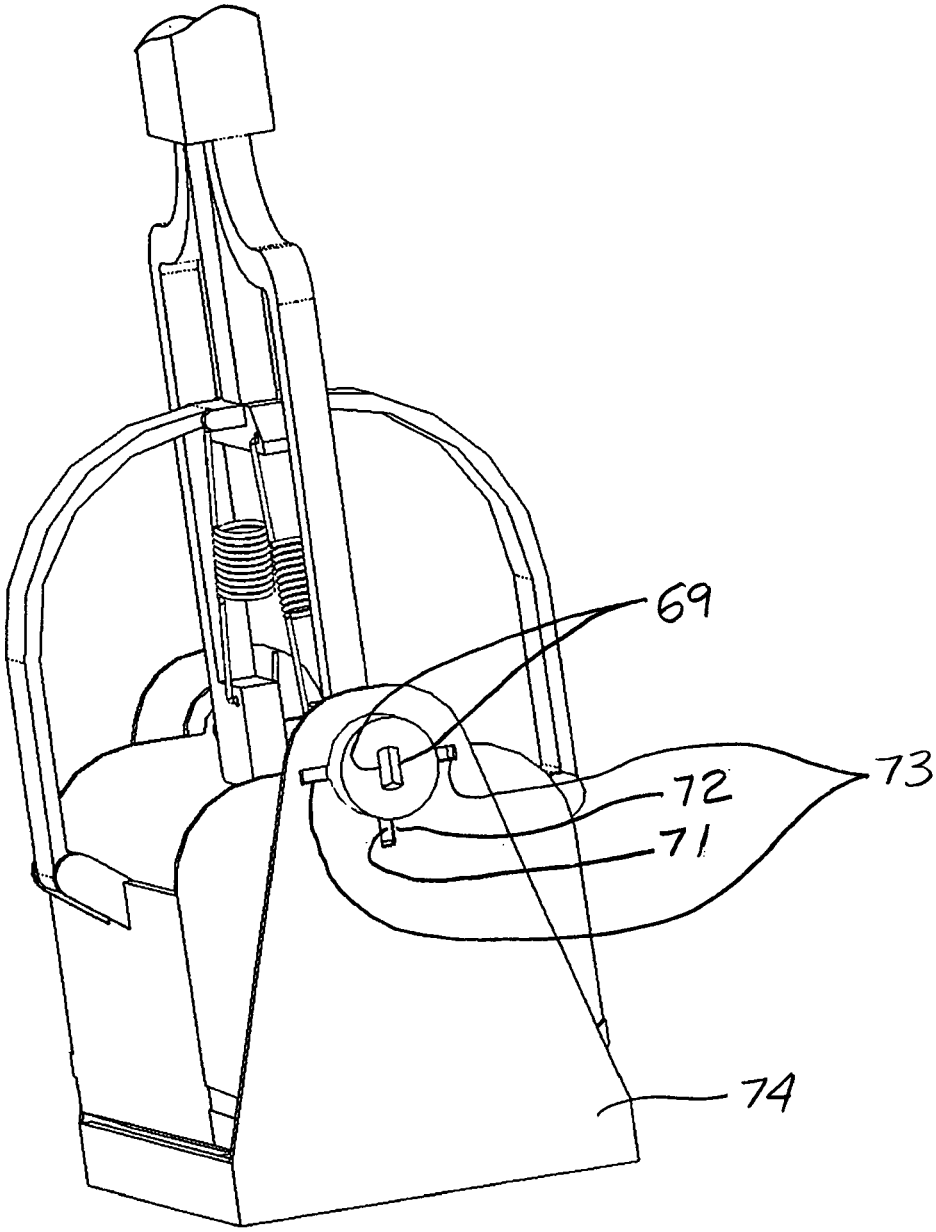
FIG. 3 is a close-up perspective view of the waste retrieval device with storage stand, shown in the storage position.

Referring now to FIG. 3, the waste retrieval device 1 is shown in the storage position. Tab 71 resides in central hole 72 when the waste retrieval device is stored and in either of the other 2 holes 73 when the waste retrieval device is being used to pick up waste.

Figure 4:
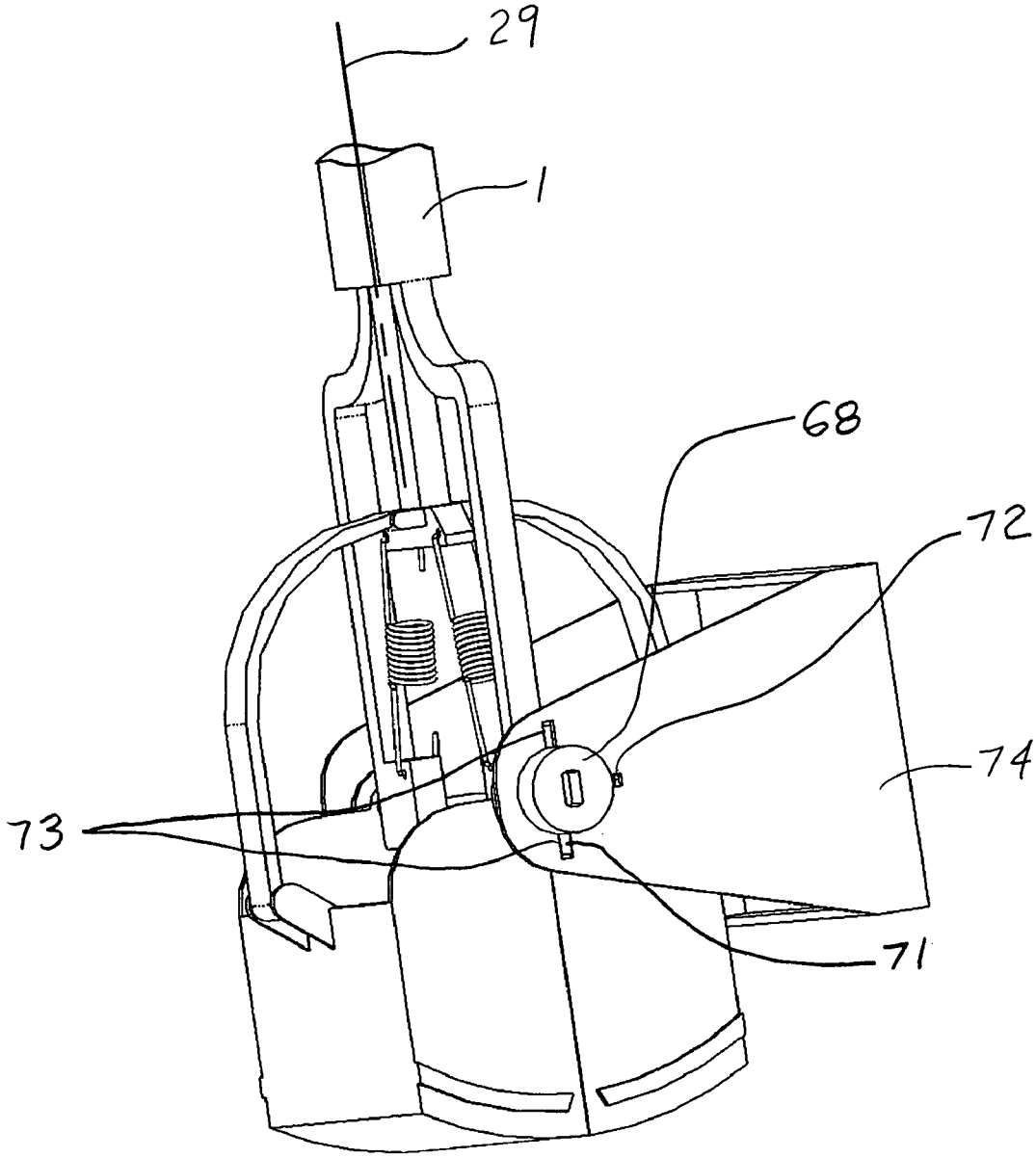
FIG. 4 is a similar view to FIG. 3, with the storage stand rotated out of the way such that the scoops may be used.

Referring now to FIG. 4, the waste retrieval device 1 is shown in the usage position. To move storage stand 74 from the storage position, the user taps the button 68 with his/her foot while holding the waste retrieval device with long axis 29 at a slight angle from vertical. Once tab 71 of button 68 clears hole 72 of storage stand 74, storage stand rotates freely about nipples 14 and 67 (see FIG. 2). By then turning waste retrieval device 1 such that long axis 29 is approximately horizontal, tab 71 will enter either of holes 73, temporarily locking storage stand 74 in place. When the user is finished using the waste retrieval portion, the user taps the button 68 once again with his/her foot while holding the waste retrieval device 1 with long axis 29 approximately vertical, and storage stand 74 will rotate to the storage position once again and lock in place.

While the present invention has been particularly shown and described with reference to preferred embodiments thereof, it will be understood by those skilled in the art that various changes in form and details may be made therein without departing from the spirit and scope of the invention.

What is claimed is:

1. A waste retrieval device comprising a waste retrieval portion and a storage bin, wherein the waste retrieval portion comprises:

an elongated outer frame having a handle at one end and scoop supporting section at the other end;

a control frame carried by the outer frame having a handle at one end and link connection at the other end;

a pair of scoops pivotally mounted on said scoop supporting section;

at least one link connected to each of said scoops and to said control frame;

a spring biasing mechanism connected to the control frame and the outer frame for biasing the pair of scoops in a closed position;

wherein said waste retrieval portion is connected to said storage bin; and wherein said connection between waste retrieval portion and storage bin allows free-standing storage of said waste retrieval device with long axis of said elongated outer frame in a substantially vertical orientation.

2. The waste retrieval device as set forth in claim 1, wherein said storage bin pivots about said scoop supporting section of said waste retrieval portion.

3. The waste retrieval device as set forth in claim 2, wherein said storage bin may be temporarily locked in a position such that said waste retrieval device may be stored with said long axis in a substantially vertical orientation.

4. The waste retrieval device as set forth in claim 3, wherein said storage bin may further be temporarily locked in a position such that said storage bin will not interfere with the waste retrieval process.

5. The waste retrieval device as set forth in claim 1, wherein said connection between waste retrieval portion and storage bin is detachable.

6. A waste retrieval device comprising a waste retrieval portion and a storage bin, wherein the waste retrieval portion comprises:

an elongated outer frame having a handle at one end and scoop supporting section at the other end;

a control frame carried by the outer frame having a handle at one end and link connection at the other end;

a pair of scoops, with one of the scoops being pivotally mounted on said scoop supporting section;

a link connected to said pivoting scoop and to said control frame;

a spring biasing mechanism connected to the control frame and the outer frame for biasing said pivoting scoop in a closed position;

wherein said waste retrieval portion is connected to said storage bin; and wherein said connection between waste retrieval portion and storage bin allows free-standing storage of said waste retrieval device with long axis of said elongated outer frame in a substantially vertical orientation.

7. The waste retrieval device as set forth in claim 6, wherein said storage bin pivots about said scoop supporting section of said waste retrieval portion.

8. The waste retrieval device as set forth in claim 7, wherein said storage bin may be temporarily locked in a position such that said waste retrieval device may be stored with said long axis in a substantially vertical orientation.

9. The waste retrieval device as set forth in claim 8, wherein said storage bin may further be temporarily locked in a position such that said storage bin will not interfere with the waste retrieval process.

10. The waste retrieval device as set forth in claim 6, wherein said connection between waste retrieval portion and storage bin is detachable.

* * * * *